US007553515B2

(12) United States Patent
Gambini

(10) Patent No.: US 7,553,515 B2
(45) Date of Patent: Jun. 30, 2009

(54) METHOD FOR DISTRIBUTING GLUE ON AN END EDGE OF A LOG, ON A LOG, OR ON A CORE FOR LOGS

(76) Inventor: Giovanni Gambini, Via A. Omodeo 7, Pisa (IT) I-56124

( * ) Notice: Subject to any disclaimer, the term of this patent is extended or adjusted under 35 U.S.C. 154(b) by 22 days.

(21) Appl. No.: 12/005,243

(22) Filed: Dec. 26, 2007

(65) Prior Publication Data

US 2008/0107807 A1 May 8, 2008

Related U.S. Application Data

(62) Division of application No. 11/318,676, filed on Dec. 27, 2005, now Pat. No. 7,335,263.

(30) Foreign Application Priority Data

Dec. 29, 2004 (IT) ..... MI2004A2546

(51) Int. Cl.
*B05C 1/02* (2006.01)
*B65H 81/00* (2006.01)

(52) U.S. Cl. ..... 427/207.1; 118/120; 118/241; 156/578; 427/536

(58) Field of Classification Search ..... 427/207.1, 427/536; 118/120, 241; 156/578
See application file for complete search history.

(56) References Cited

U.S. PATENT DOCUMENTS

| | | | | |
|---|---|---|---|---|
| 3,369,766 | A | 2/1968 | Herman | |
| 3,735,733 | A * | 5/1973 | Henc | 118/261 |
| 5,242,525 | A | 9/1993 | Biagiotti | |
| 5,259,910 | A | 11/1993 | Biagiotti | |
| 5,681,421 | A | 10/1997 | Biagiotti | |
| 5,716,489 | A | 2/1998 | Biagiotti | |
| 6,143,111 | A | 11/2000 | Biagiotti | |
| 6,565,658 | B2 * | 5/2003 | Fischer et al. | 118/259 |
| 6,682,623 | B1 | 1/2004 | Biagiotti | |
| 2004/0256513 | A1 | 12/2004 | Perini | |
| 2006/0076451 | A1 | 4/2006 | Biagiotti et al. | |
| 2007/0023562 | A1 | 2/2007 | Perini | |

OTHER PUBLICATIONS

European Search Report, Apr. 25, 2007.

* cited by examiner

*Primary Examiner*—Michael Kornakov
*Assistant Examiner*—Xiao Zhao
(74) *Attorney, Agent, or Firm*—James V. Costigan; Hedman & Costigan, P.C.

(57) ABSTRACT

A method for distributing glue on an end edge of a log, on a log, or on a core for logs which advances logs on a feed surface toward a glue reservoir wherein a fixed blade, coupled to a movable plate, distributes the glue from said reservoir to the log by conveying said plate upwards and discharging said glue to an upper free end of the fixed blade, returning said plate downwards, and passing said log over said fixed blade.

1 Claim, 4 Drawing Sheets

METHOD FOR DISTRIBUTING GLUE ON AN END EDGE OF A LOG, ON A LOG, OR ON A CORE FOR LOGS

This is a divisional application of Ser. No. 11/318,676, filed Dec. 27, 2005 now U.S. Pat. No. 7,335,263 which claims priority from Italian Application No. MI2004A 002546, filed Dec. 29, 2004.

The present invention relates to a device and to a method for distributing glue on an end edge of a log, on a log or on a core for logs.

It is currently known that a quantity of glue is distributed or positioned both on the end edge of each log formed or on the body of the log and, upstream, on the core to be placed inside the log, if this is present. This occurs in the field of preparation of rolls of toilet paper, paper for domestic use and the like, which are known as "logs". More specifically, as is known, the glue is therefore used on the one hand to join the final end to the remaining part of the roll, and on the other hand to allow the initial end of the roll, which is to be formed, to be attached firmly to the core.

More specifically, devices or appliances are provided which deposit the glue by spraying or which pass the end edge or the core over a slot at the level of which glue is dispensed by means of overflow.

Although functioning well, these known devices do not make glue distribution extremely easy. In one case, deposition of the glue, being performed by means of dispensers, is not always continuous and straight and can cause glue to be deposited also in unwanted parts of the paper or can soil the machine. Moreover, the dispensing devices are delicate and require regular checking and adjustment to prevent excessive or unnecessary amounts of glue from being used.

In the other case, as glue is delivered through the slot by means of overflow, with the end edge of the log or the core passing over said slot, both the machine and the roll can become soiled.

Furthermore, devices are provided in which to obtain gluing, the end edge or core must be made to pass over a slot above a container in which both glue and a movable assembly are provided. This movable assembly is immersed in the glue and is then moved towards the opening to apply the glue to the product. Therefore, this is a movable assembly which applies glue. Moreover, in these devices the movable assembly, which carries the glue to the level of the dispensing slot, is in the upper position thereof when the log is made to roll over the slot.

In this case the movement between the parts must be specifically correlated, so that the movable assembly is at the level of the slot when the paper or core passes over it.

The object of the present invention is therefore to identify a different solution to the technical problem set forth above.

Another object is to produce a device which always guarantees complete distribution of the glue along the entire crosswise dimension of the end edge of the log, of the body of the log or of the inner core of the log.

A further object is to produce a device suitable to perform the aforesaid task which is particularly simple to operate and does not soil either paper or machine.

These and other objects according to the present invention are obtained by producing a device for distributing glue on an end edge of a log, on a log or on a core for logs and a relative method as set forth in the appended independent claims.

Further characteristics of the invention form the object of the dependent claims.

The characteristics and advantages of a device for distributing glue on an end edge of a log, on a log or on a core for logs and a relative method according to the present invention will be more apparent from the description hereunder, provided as a non-limiting example, of an embodiment with reference to the appended figures wherein.

Figure 1:
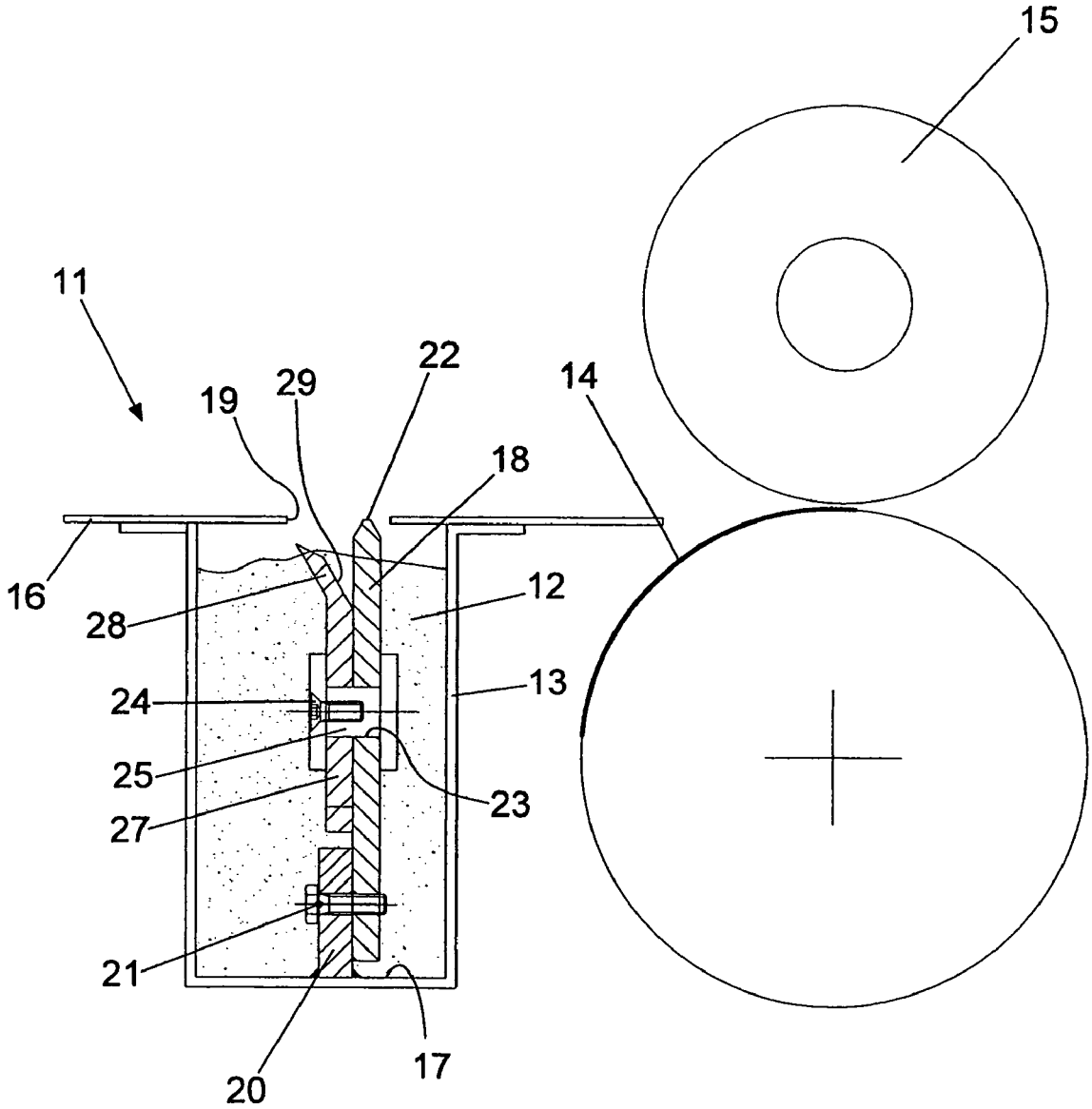
FIG. 1 is a partial longitudinal sectional view of a device according to the present invention in a first idle position, standing by for an end edge of the paper of the log, a log, or also a core, disposed individually on a feed surface, to reach it.

In general, with reference to FIGS. 1-4, a device for distributing glue on an end edge of a log, on a log or on a core of a log, and phases of a relative method according to the present invention are shown.

In particular, a device of this kind, indicated as a whole with 11, is shown to distribute glue 12 contained in a container 13 on a body of a log 15 advancing inside any type of machine for the production of logs. The device of the invention is disposed crosswise to the direction of feed of the logs or paper being wound on the core or of the roll which is about to finish being wound.

The device 11 comprises, downstream of a feed surface 16, the container 13, disposed inside which, fixed to a base 17 of the container 13, is a blade 18 facing upwards. In particular, this blade 18 protrudes slightly from an interrupted section 19 of the feed surface 16 on which the logs 15 advance one behind another.

More precisely, the base 17 has an appendix 20, facing upwards, which by means of bolts 21 supports the above mentioned blade 18 having an upper end 22 of limited narrower dimension or pointed, chosen as a function of the quantity of glue to be used. In turn, this blade 18 has holes 23, produced in an intermediate portion thereof, in which cylindrical rollers 25 are inserted, clamped in position by means of bolts 24, which act as guiding elements of slotted grooves 26, for example produced inclined with respect to the vertical in a movable plate 27, associated with the fixed blade 18.

The movable plate 27 has an upper edge 28, bent away from the blade 18, which forms therewith a movable chamber 29 to collect a certain quantity of glue 30.

The movable plate 27 is made to move upwards and downwards by means of an actuator 31, such as a cylinder. In particular, a rod 32 of the cylinder 31 is connected by means of a pin 33 to a lug 34 of the movable plate 27, which in the example has been positioned at one side end of the movable plate 27.

FIG. 1 exemplifies a first operating phase of the device in which a log 15 advances towards the device 11 on the feed surface 16. In particular, in the feed surface 16 an opening 35 is, for example, provided, in which an end edge 14 of the log 15 is placed.

In this position the movable plate 27 is immersed in the glue 12, as is the upper edge 28 thereof, so that a certain quantity of glue 30 collects in the chamber 29.

Figure 2:
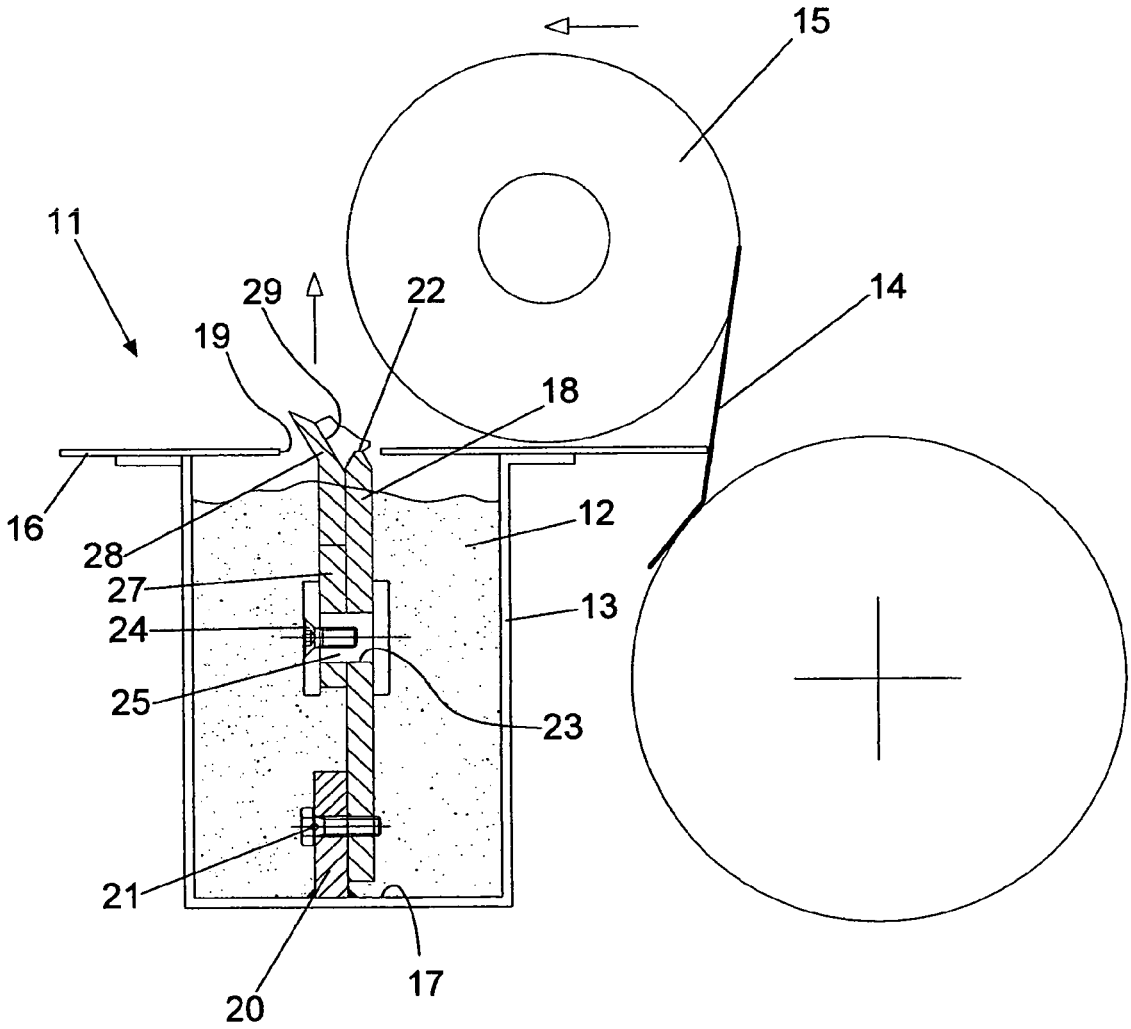
FIG. 2 is a view entirely similar to the one in FIG. 1 in which glue is transferred to a fixed blade of the device of the invention.
Figure 3:
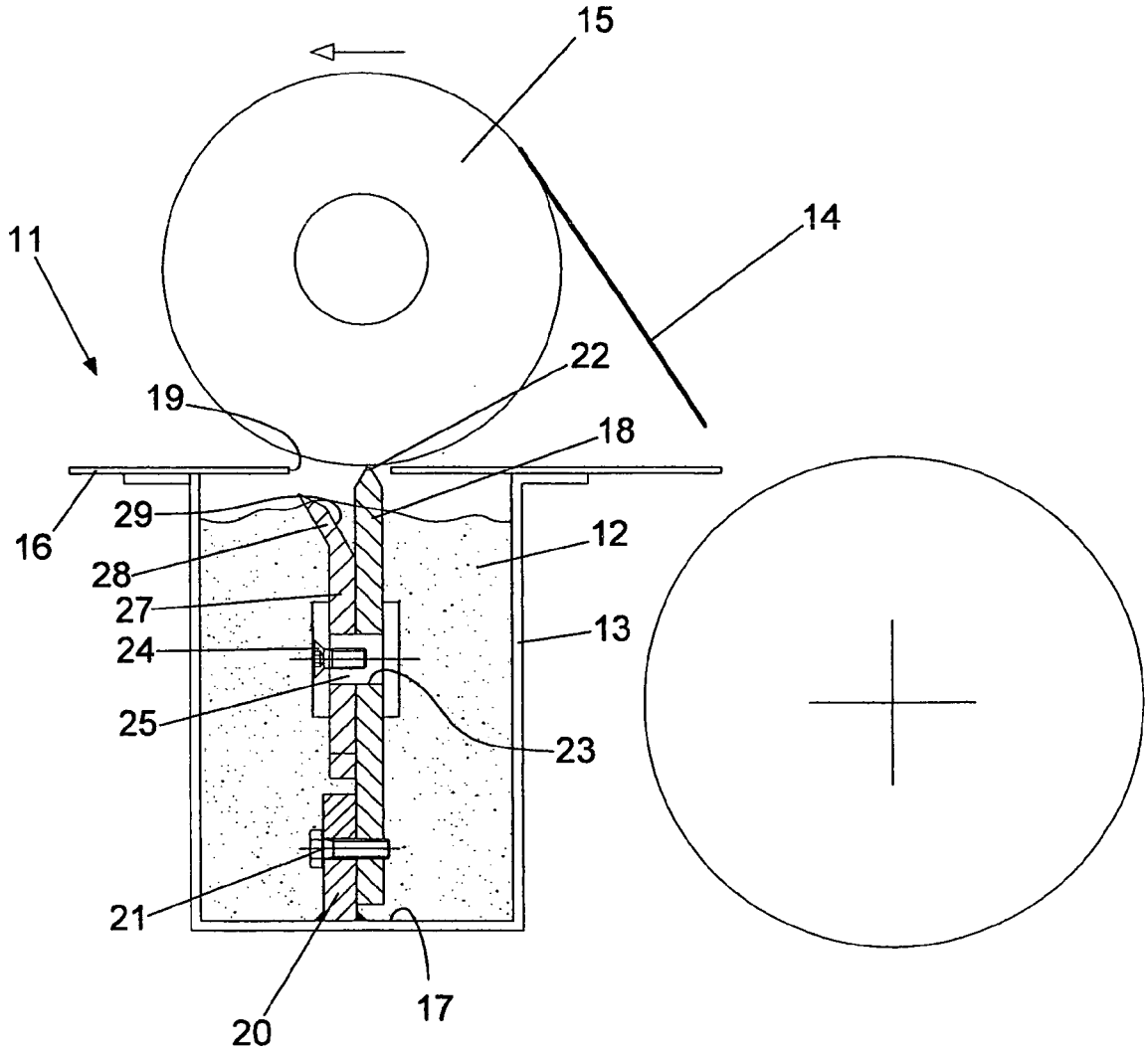
FIG. 3 is a view entirely similar to the one in FIG. 1 in which the glue is picked up from the fixed blade by the end edge of the paper of the log, the body of the log or the core.
Figure 4:
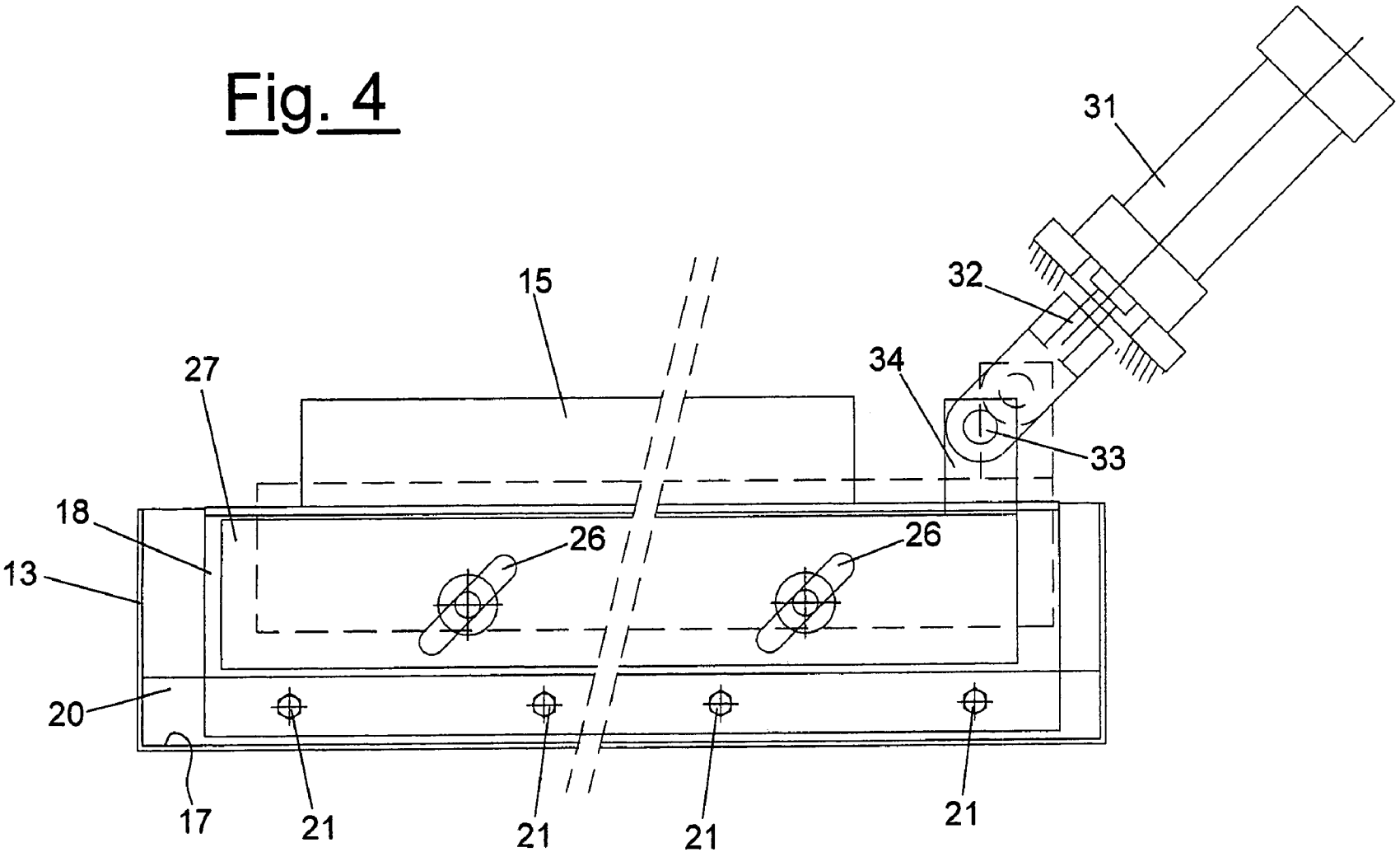
FIG. 4 is a partial cross-sectional view of the device according to the invention, in which the position taken in FIG. 2 is indicated with a dashed line and the position taken in FIG. 3 is indicated with a solid line.

FIG. 2 shows how in a subsequent phase, while the log 15, with the end edge 14 withheld, advances on the feed surface 16, the movable plate 27, with a certain quantity of glue 30 collected at the upper end 28 thereof in the chamber 29, is raised by operation of the cylinder 31. In fact, the cylinder retracts its rod 32, to which the lug 34 of the movable plate 27 is connected by means of the pin 33. In this movement the movable plate 27 is guided by the slotted grooves 26 thereof, which slide on the cylindrical rollers 25, clamped to the blade 18 by means of the bolts 24.

This upward movement continues until the chamber 29 of the movable plate 27 in which a certain quantity of glue 30 is collected reaches the level of the upper end 22 of the blade 18 and here discharges the glue.

As soon as this operation has terminated, the cylinder 31 reverses its travel and causes the rod 32 to extend, so that the movable plate 27 moves downwards until it is inside the glue.

In this way, the movable plate 27 is taken well below the feed surface 16, from which the upper end 22 of the blade 18, on which a certain quantity of glue 12 has been discharged, instead slightly protrudes.

It is only at this instant that the log 15, with the end edge 14 still withheld, continuing to advance on the feed surface 16, reaches the position over the fixed blade 18, picking up the glue 12 present thereon. By continuing to advance and simultaneously releasing the end edge 14 of the log 15 withheld, said end edge 14 is rewound and adheres to the glue 12 disposed on the body of the log 15, which rolls and advances on the feed surface 16.

Stable positioning of the end edge 14 of the log 15 on the same log is thereby obtained.

Succession of these phases and relative synchronous implementation of the elements of the device allow rapid and fast operation of the entire device according to the invention inside a finishing gluing device of the logs, before they are sent to be cut into small rolls of the desired and chosen size.

It has thus been seen that it is in the instant in which the log 15 is made to "jump" over the fixed blade 18 that the body of the log receives thereon a strip (not shown) of glue 12. It is then the end edge 14 of the log, which rewinding on the body of the log 15 is connected thereto due to the presence of the glue picked up from the fixed blade 18.

It is in any case possible in an entirely equivalent manner, by means of different positioning and movement of the parts, for the final end 14 to be made to pass over the fixed blade 18 to pick up the glue and for this edge to then be rewound on the body of the log.

It must also be borne in mind that the device could also be used in such a way that a core, which is disposed inside a log, can pick up a strip of glue 12 by passing in contact with the fixed blade 18, when said core is required inside the log to be formed.

It has thus be seen that a device to distribute glue on an end edge of a log, on a log or on a core for logs according to the present invention produces the objects set forth hereinbefore.

The operating phases of the device show how according to the present invention a new and inventive method has also been implemented for distributing glue on an end edge of a log, on a log or on a core for logs.

In particular, it must be observed that a device according to the invention has a series of advantages which allow differentiated operation.

For example, it has been said that the fixed blade has an upper end 22 of limited narrow dimensions or pointed, chosen as a function of the quantity of glue which is to be used. This makes it possible to establish the quantity of glue to be present on the fixed blade 18 at the instant in which the body of the log or the end edge thereof picks up the glue. In this situation it is possible to provide quantities of glue which vary as a function of the type of paper and/or the type of use of the log to be finished.

It has also been seen that, due to the construction proposed or, more generally, due to the fact that both the fixed blade 18 and the movable plate 27 can be removed, it is possible to act on the type thereof. If it is considered useful to have a type of fixed blade 18 with a pointed or flat upper end, it is easy to replace it immediately by acting on the bolts 21 connecting it to the appendix 20 of the base 17, facing upwards, which supports the fixed blade 18.

The same thing can be said for the movable plate 27, which can be replaced when the quantity of glue to be conveyed towards the end of the fixed blade requires to be varied. This movable plate 27 can therefore be removed and replaced with a different movable plate 27 with an upper edge 28 with different inclination and suitable to receive a different quantity of glue 30 in the chamber 29.

This can all be performed with extreme simplicity and rapidity even during a short break in the work cycle, without requiring to disassemble relevant machine parts.

Therefore, the device and the method of the present invention thus conceived are susceptible to numerous modifications and variants, all falling within the scope of the invention.

Moreover, in practice the materials used, and the dimensions and components thereof, may be any in accordance with technical requirements.

The invention claimed is:

1. Method for distributing glue on an end edge of a log, on a log or on a core for logs which advance on a feed surface (16) of logs or cores (15) towards a glue distribution area, wherein a fixed blade (18) is disposed with one free end (22) facing upwards at the level of an interrupted section (19) of the feed surface (16) and a plate (27) is provided movable from the bottom upwards, and vice versa, associated with said fixed blade (18) which conveys the glue (12) to the level of an upper free end (22) of the fixed blade (18), the method providing for the phases of collecting a quantity of glue by means of said movable plate (27) and conveying upwards and discharging said glue on the upper free end (22) of the fixed blade (18), of returning said movable plate (27) downwards, of passing an end edge (14) of a log (15), of a body of the log (15) or a core for logs over said fixed blade 18), and of advancement of the end edge (14) of the log (15), of the body of the log (15) or of the core for logs on the feed surface (16).

* * * * *